US009648918B2

(12) United States Patent
Grady

(10) Patent No.: US 9,648,918 B2
(45) Date of Patent: May 16, 2017

(54) PERSONAL ITEM PROTECTOR APPARATUS

(76) Inventor: Victor Eugene Grady, Irvine, CA (US)

( * ) Notice: Subject to any disclaimer, the term of this patent is extended or adjusted under 35 U.S.C. 154(b) by 492 days.

(21) Appl. No.: 13/278,433

(22) Filed: Oct. 21, 2011

(65) Prior Publication Data

US 2012/0096628 A1 Apr. 26, 2012

Related U.S. Application Data

(60) Provisional application No. 61/406,935, filed on Oct. 26, 2010.

(51) Int. Cl.
*A41D 27/20* (2006.01)
*A45F 5/02* (2006.01)

(52) U.S. Cl.
CPC ..... *A41D 27/204* (2013.01); *A41D 27/20* (2013.01); *A45F 5/022* (2013.01); *A45F 2200/0541* (2013.01)

(58) Field of Classification Search
CPC ... A41D 13/0012; A41D 27/20; A41D 27/205
USPC ..... 2/247, 250, 252, 94
See application file for complete search history.

(56) References Cited

U.S. PATENT DOCUMENTS 555,227 A * 2/1896 Teuber et al. ..... 2/254
1,649,225 A * 11/1927 Grundmann ..... 24/3.5
1,879,341 A * 9/1932 Lapham ..... 2/102
1,982,100 A * 11/1934 Heile ..... A41D 27/20 2/253
2,211,550 A * 8/1940 Tworoger ..... A41D 27/20 2/253
2,439,097 A * 4/1948 Pierce ..... 2/113
2,810,132 A * 10/1957 Nicholson ..... 2/247
3,276,040 A * 10/1966 Belzer ..... 2/250
4,062,064 A * 12/1977 Vosatka ..... 2/252
4,637,075 A * 1/1987 Ingrisano et al. ..... 2/94
4,825,471 A 5/1989 Jennings
4,879,165 A * 11/1989 Smith ..... B32B 7/02 109/49.5
4,896,377 A * 1/1990 Ferdi ..... 2/115
5,014,359 A * 5/1991 Hanson ..... 2/94
5,072,456 A * 12/1991 Elin ..... A41D 27/20 2/102
5,398,345 A * 3/1995 Kenneth et al. ..... 2/247
5,509,147 A * 4/1996 Busquets ..... 2/253
5,517,696 A * 5/1996 Krugler ..... 2/250
5,584,074 A * 12/1996 Battle-Smith ..... 2/115
5,903,928 A * 5/1999 Hyung-Seob ..... 2/244
(Continued)

*Primary Examiner* — Tejash Patel

(57) ABSTRACT

An apparatus and a system for support and/or holder for implements, and more specifically, for the securement and transport of personal items such as eyewear is provided. The apparatus may be used with a shirt. For example, the shirt can include a first protector pocket attached to the shirt, the first protector pocket including a pull tab loop with an open portion in the center. The shirt can also include a second protector pocket attached to the shirt, the second protector pocket including a vertical loop. A first shorter pocket can be in front of a second taller pocket. The pocket can include a notch such as a semi-circular notch, a rectangular notch formed on the face of the pocket or a notch that is formed on the side of the pocket and defined by two areas of stitching, one above the notch and a second below the notch.

4 Claims, 12 Drawing Sheets

(56) References Cited

U.S. PATENT DOCUMENTS

| | | | | |
|---|---|---|---|---|
| 6,216,280 | B1 | 4/2001 | Rabe | |
| 6,311,335 | B1 * | 11/2001 | Uchida | 2/247 |
| 6,339,846 | B2 * | 1/2002 | Uchida | 2/247 |
| 6,626,733 | B1 * | 9/2003 | Knutson | A41C 3/0057 2/247 |
| 6,763,527 | B1 * | 7/2004 | Rivoli et al. | 2/250 |
| 7,364,491 | B2 | 4/2008 | Updyke | |
| 7,575,094 | B1 | 8/2009 | Rosenberg | |
| D622,940 | S | 9/2010 | Shen et al. | |
| 7,886,368 | B2 * | 2/2011 | Hood | A41D 1/002 2/102 |
| 8,250,671 | B2 * | 8/2012 | Shadid | 2/94 |
| 8,256,024 | B2 * | 9/2012 | Roberts | A41D 3/005 2/108 |
| 2002/0197960 | A1 | 12/2002 | Lee et al. | |
| 2004/0154076 | A1 | 8/2004 | Yoo | |
| 2005/0144704 | A1 * | 7/2005 | Vitallo | 2/247 |
| 2005/0235398 | A1 | 10/2005 | Yoo | |
| 2005/0246823 | A1 * | 11/2005 | Groom | 2/247 |
| 2006/0075537 | A1 | 4/2006 | Tsai | |
| 2006/0206990 | A1 | 9/2006 | Demus | |
| 2006/0280322 | A1 | 12/2006 | Abe | |
| 2007/0245444 | A1 * | 10/2007 | Brink | 2/69 |
| 2007/0261703 | A1 | 11/2007 | Gheneva et al. | |
| 2008/0184459 | A1 | 8/2008 | Barnes | |
| 2008/0196140 | A1 | 8/2008 | Mayerson et al. | |
| 2008/0216205 | A1 * | 9/2008 | Conley et al. | 2/82 |
| 2009/0094725 | A1 * | 4/2009 | Smith et al. | 2/69 |
| 2009/0139013 | A1 | 6/2009 | Sapowycz et al. | |
| 2009/0320183 | A1 * | 12/2009 | Riney | 2/250 |
| 2011/0145969 | A1 | 6/2011 | Witten et al. | |
| 2011/0185471 | A1 * | 8/2011 | Buczkowski | A41D 27/20 2/84 |
| 2016/0206017 | A1 * | 7/2016 | Aylward | A41D 27/205 |

* cited by examiner

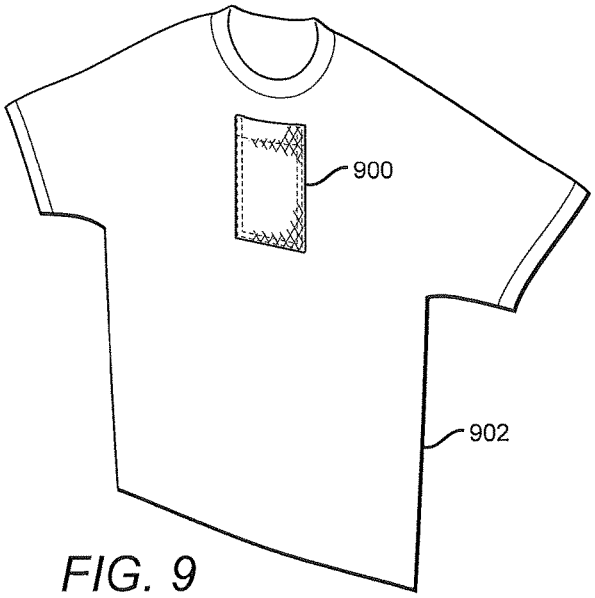
FIG. 9
FIG. 10
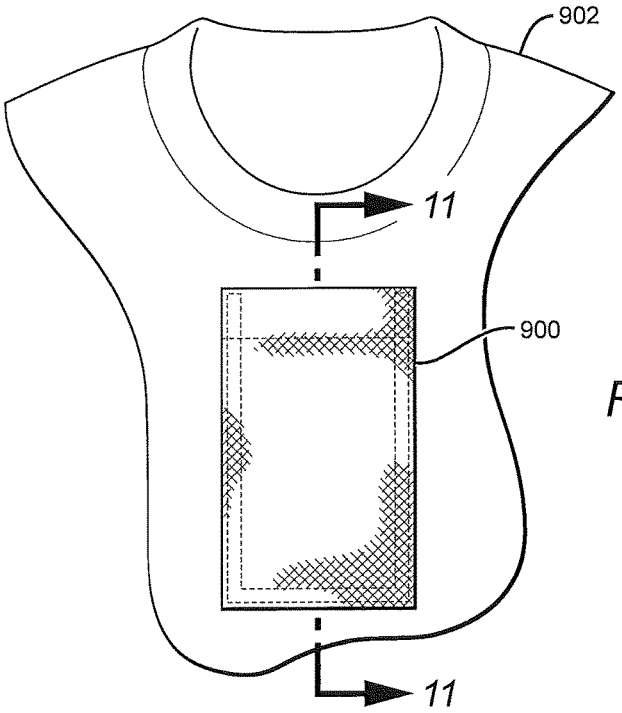
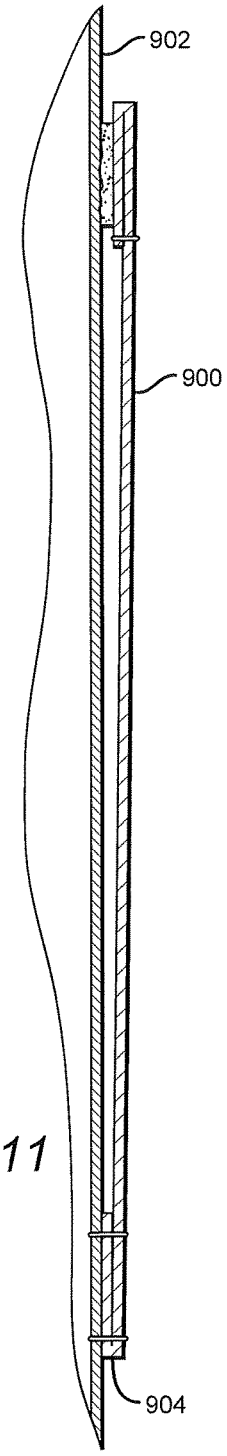
FIG. 11

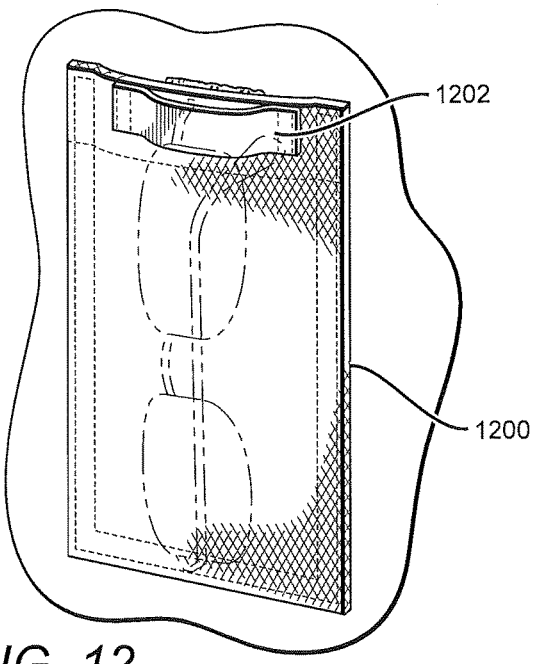
FIG. 12
FIG. 13
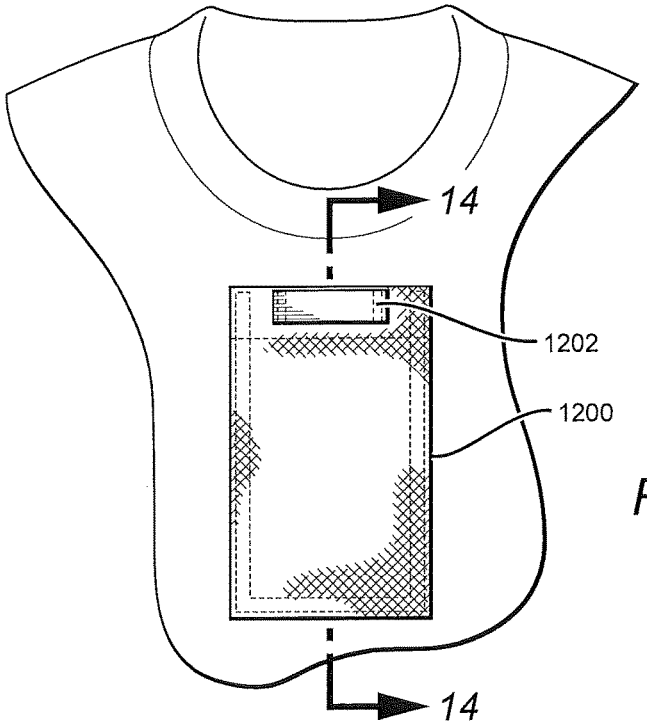
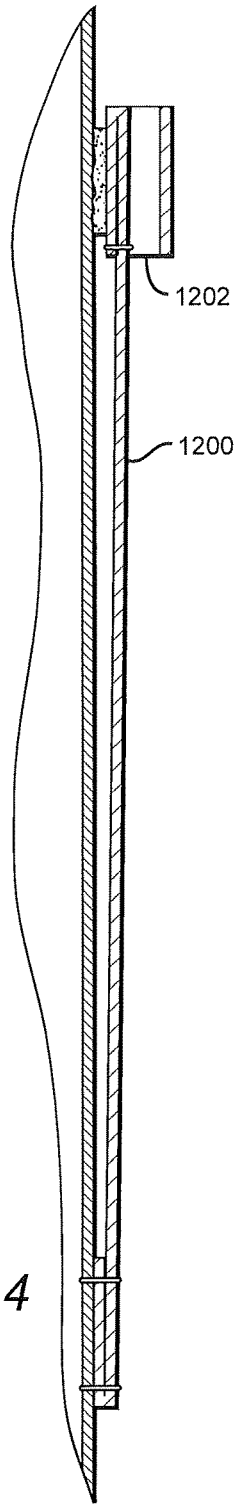
FIG. 14

FIG. 18
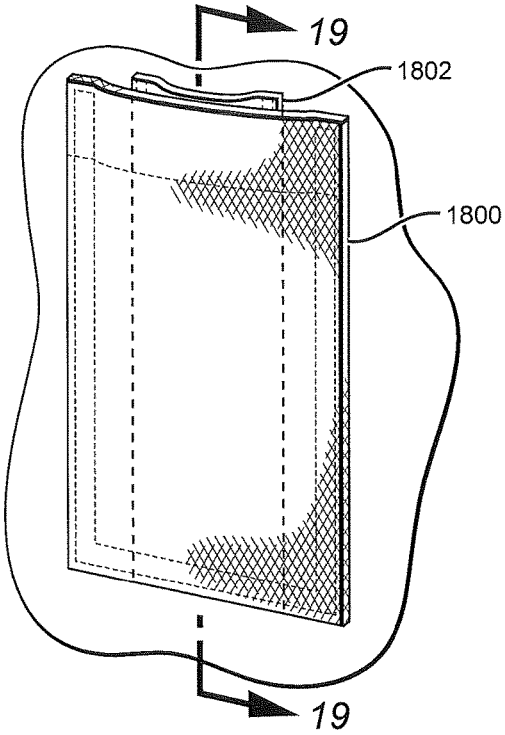
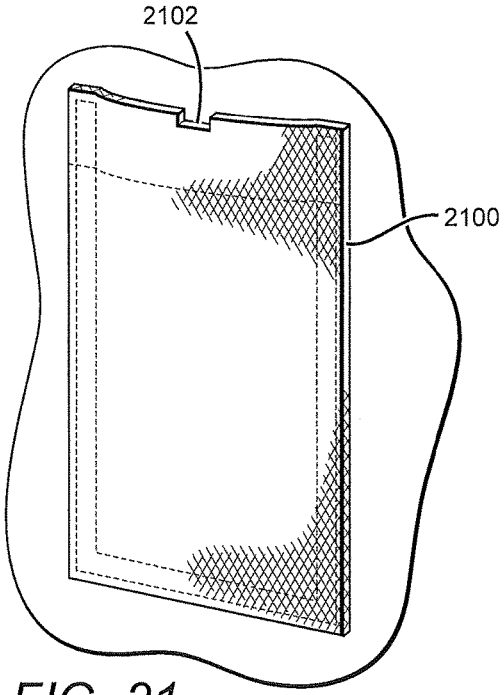
FIG. 21
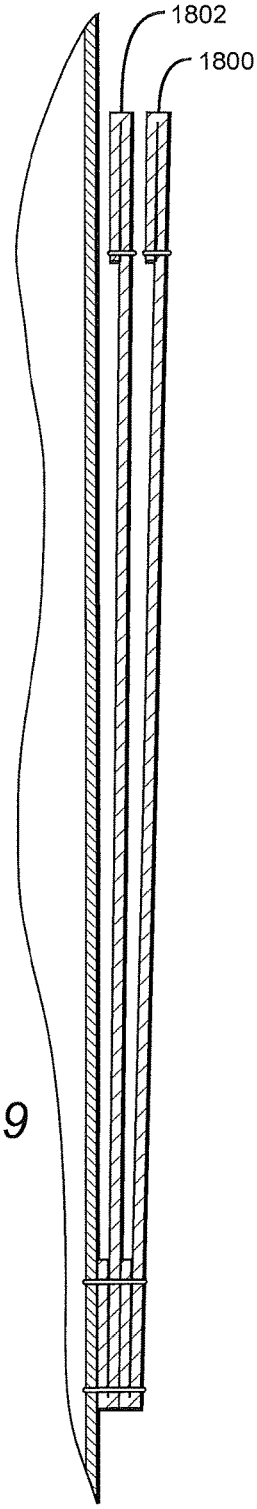
FIG. 19

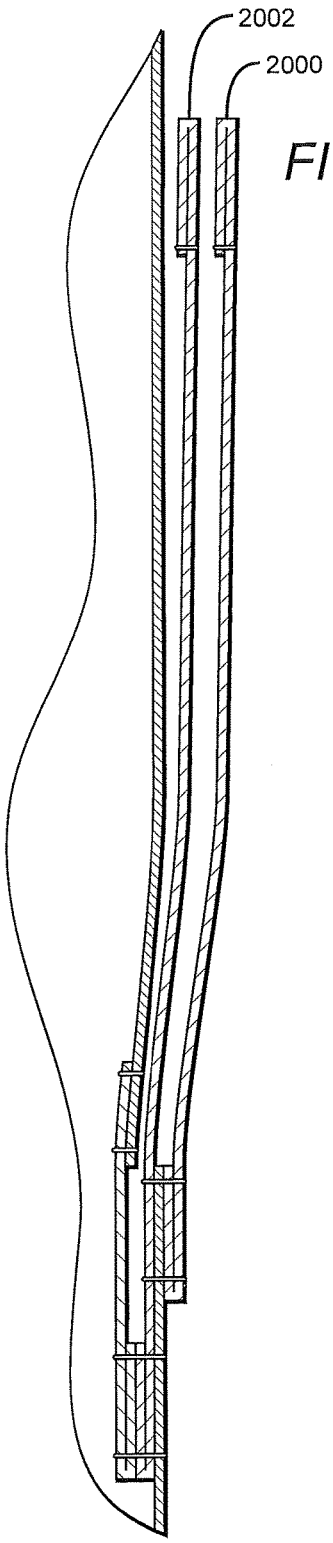
FIG. 20
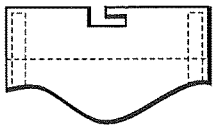
FIG. 22
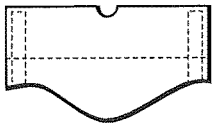
FIG. 23
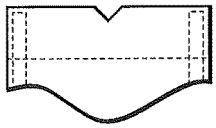
FIG. 24
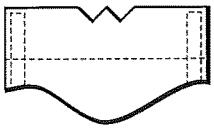
FIG. 25
FIG. 26
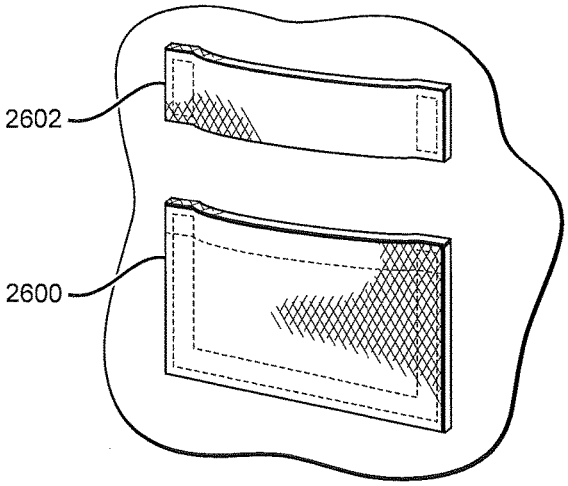

FIG. 27
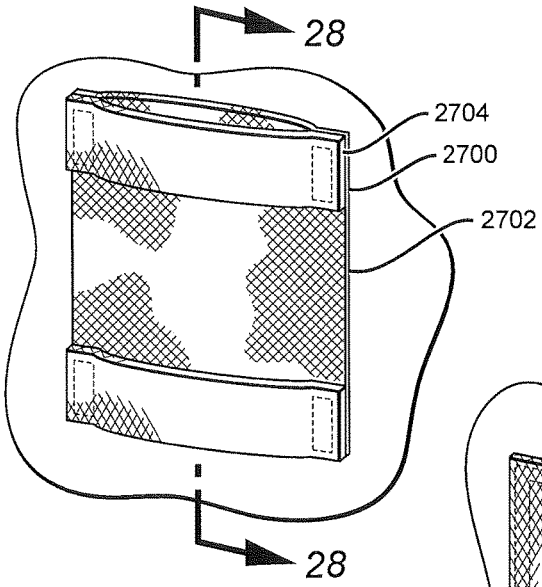
FIG. 29
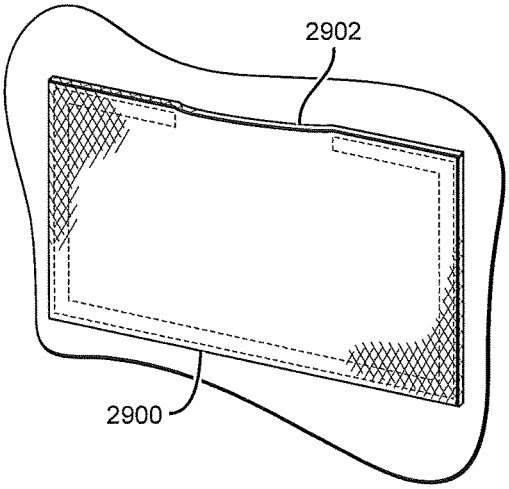
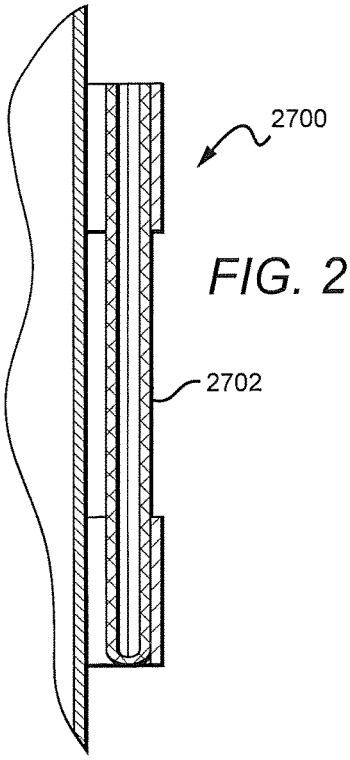
FIG. 28
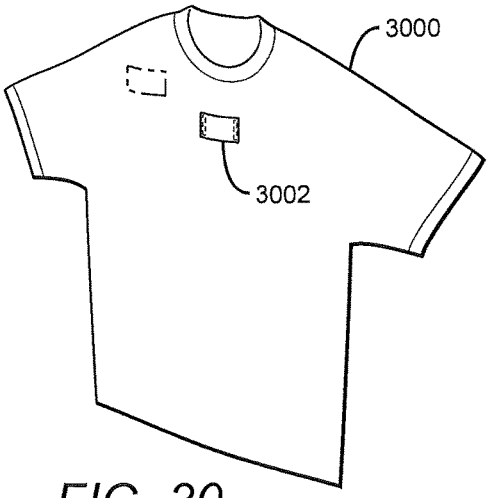
FIG. 30

FIG. 31
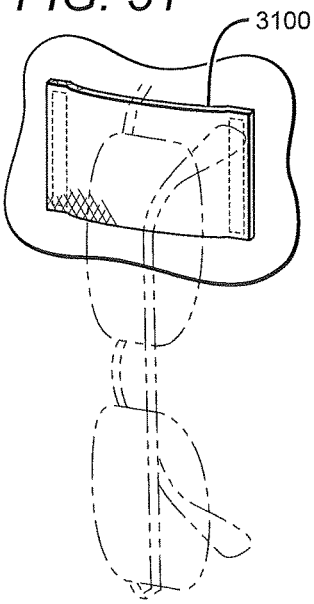
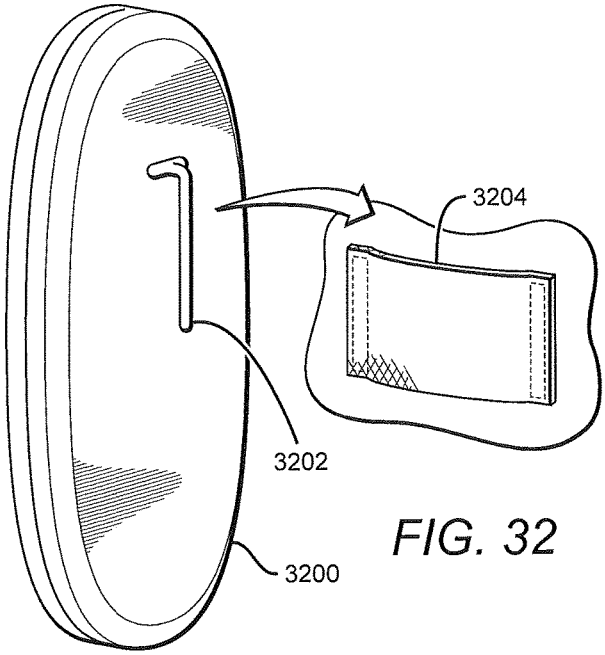
FIG. 32
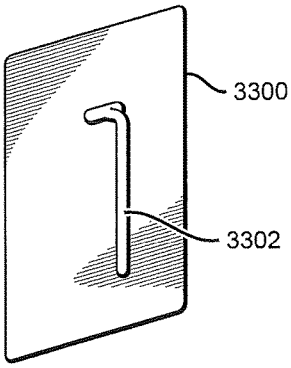
FIG. 33
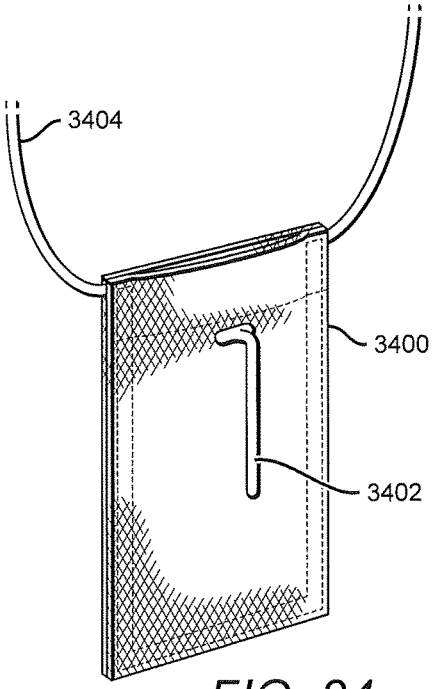
FIG. 34

FIG. 35
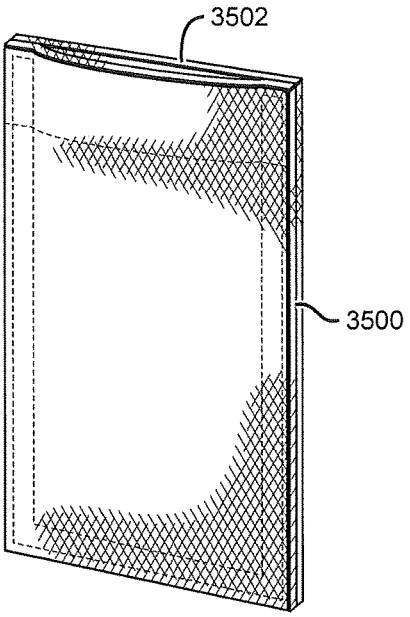
FIG. 36
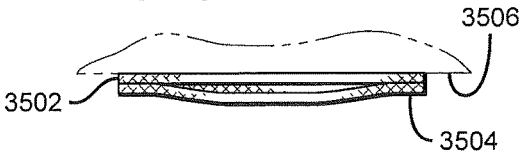
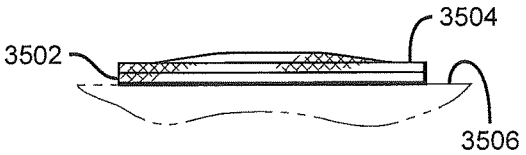
FIG. 37
FIG. 38
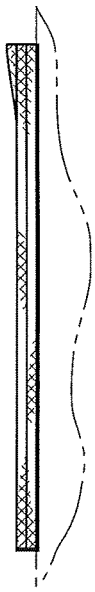
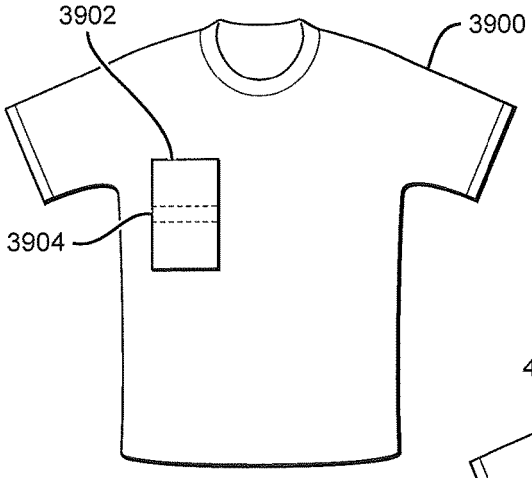
FIG. 39
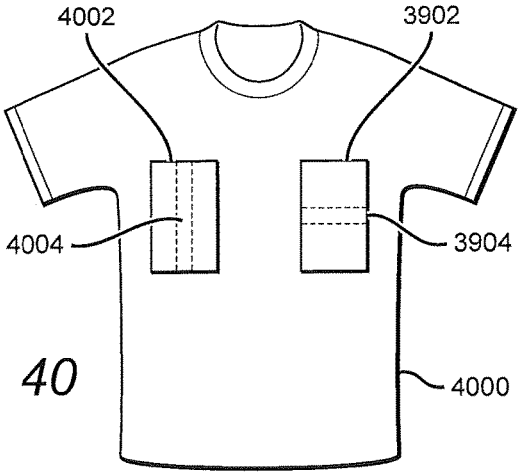
FIG. 40

PERSONAL ITEM PROTECTOR APPARATUS

CROSS-REFERENCE TO RELATED APPLICATION(S)

This application claims the benefit of, and priority to, U.S. Provisional Application No. 61/406,935, filed on Oct. 26, 2010, entitled "Eyewear Protection Apparatus," which is incorporated by reference in its entirety for all purposes.

FIELD OF THE INVENTION

The present invention generally relates to the supports and holders for implements. More specifically, the present invention relates to the securement and transport of personal items such as eyewear.

BACKGROUND OF THE INVENTION

There are various methods and systems that currently exist for transporting and keeping a user's eyewear when not being worn, yet having it readily available when needed. One of the most common methods of transport is utilizing the shirt and/or pants pocket to secure the eyewear. However, the eyewear tends to tumble out and become scratched or bent. A flexible open-ended case or pocket protector, sometimes equipped with a pocket clip, is widely used to overcome this problem, but these are bulky and often heavier than the eyewear itself. Hinged cases that are fully closed for storage have been found less than satisfactory as well.

Eyeglass cases or sleeves are generally bulky and unflattering when carried in a pocket. Materials used to fabricate such cases may include leather or vinyl and do not permit adequate air flow when stored in a pocket. This, of course, results in a user's undesirable heat retention and perspiration leading to damage or soiling of the case. More often than not, the user chooses to avoid a storage case altogether and instead insert their eyewear directly into a pocket. Hazards of doing this are mentioned above.

To further complicate matters many types of clothing do not contain any type of pockets whatsoever. For example, sport shirts, T-shirts, skirts, some dresses and blouses do not include any pockets. The option of carrying a pair of eyeglasses in a pocket associated with trousers frequently results in ink-stained fabric or abrasions to the eyeglass lenses imparted by loose change, keys and the like. In addition, eyewear frames too often are subjected to bending or breaking when the user stoops or sits.

The same can be said when a person's eyewear is stored unprotected and commingled in a purse, handbag, or briefcase. Hard-shell, hinged cases are available for protection but are bulky and demand a significant amount of space. Wearing a pair of eyeglasses tethered or otherwise attached to retainers such as straps, chains or the commonly known "croakies" offers convenience, but may also be perceived as an annoyance or even tacky. A number of patented devices address the need for safely and conveniently storing eyeglasses (as well as other items) when not in use.

For example, there are prior art systems which secure an object to support utilizing magnetic elements. These prior art systems have a magnet disc secured by a narrow flexible loop to a temple portion of the spectacles. With general reference to the prior art, it is apparent that a market exists for an innovative securement system that would serve to safely and conveniently store items such as eyewear, pens, pencils and so forth, and do so in a dependable, non-invasive, aesthetic, and unobtrusive manner. The prior art, while trying to solve this problem, fails for a variety of reasons.

Prior art devices are seen in many cases as inappropriate for portable personal use and non-adaptable use in association with clothing. Those that are adapted to personal portability are obtrusive and unfashionable in appearance or deleterious to garment fabric when utilized. Further, it is important that the system be portable and easily put into use as required. Moreover, it is crucial that the use of a securement system avoid adverse impact on fabrics with which it may be associated or utilized.

Therefore, what is needed is a new and improved system and apparatus for transporting the eyewear of an individual. Moreover, a need exists for a novel invention that resolves the disadvantages inherent with pre-existing systems and apparatuses. Further, a need exists for an improved apparatus and system for transporting and storing the eyewear of an individual which affords greater convenience and economy of motion. With the use of this inventive portable securement system for eyewear, the simple act of depositing eyewear against one's clothing (or other convenient location) takes less effort than stowing the eyewear away or placing the eyewear on a table or countertop—perhaps to be misplaced or even permanently lost. Additionally, a need exists for an improved eyewear transport system and device which may protect the eyewear when not in use.

SUMMARY OF THE INVENTION

These and other aspects of the present invention will become apparent to those skilled in the art after reading the following description of the preferred embodiment in combination with the figures.

In an exemplary embodiment, an "eyewear protector pocket" can include a design that is an integral part of a shirt, blouse, dress suit or any type of clothing, to hold any type of eyewear.

It is further contemplated that the size and/or dimensions of the "eyewear protector pocket" can vary. The size can be unlimited. Additionally, an example embodiment can be used to hold glasses, sun glasses, eye glasses or any type of eyewear securely in the pocket.

Among the many different possibilities contemplated, an example apparatus may be closed securely with buttons, zippers, hook and loop material (Velcro®), and/or any type of fastener. The fasteners used for example is an apparatus that may enclose the eyewear into the pocket and insure that the eyewear is secure and will not fall out of the pocket. Additionally, the design and colors of the clothing with the "eyewear protector pocket" can be placed and/or be designed with unlimited shapes, forms and colors with the pockets located anywhere on the clothing.

In an exemplary embodiment of the present invention, a shirt comprising: a first protector pocket attached to the shirt, the first protector pocket including a pull tab loop with an open portion in the center; and a second protector pocket attached to the shirt, the second protector pocket including a vertical loop.

In an exemplary embodiment, a first shorter pocket in front of a second taller pocket and wherein the vertical loop is formed inside the shirt.

In an exemplary embodiment, wherein the vertical loop is longer than the pocket and formed behind the pocket.

In an exemplary embodiment, wherein the pocket further comprises a notch.

In an exemplary embodiment, wherein the notch is a semi-circular notch.

In an exemplary embodiment, wherein the notch is a rectangular notch formed on the face of the pocket.

In an exemplary embodiment, wherein the notch is a formed on the side of the pocket and defined by two areas of stitching, one above the notch and a second below the notch.

In an exemplary embodiment, wherein the vertical loop is formed outside the shirt.

In an exemplary embodiment, wherein the vertical loop is formed inside the shirt.

In an exemplary embodiment, wherein the vertical loop is formed on the front of the pocket.

In an exemplary embodiment of the present invention, a securement system comprising: a protector pocket; a flap, attached to the protector pocket; and a fastener, attached to the protector pocket and configured to attach the protector pocket to an article of clothing.

In an exemplary embodiment, wherein the fastener includes thread.

In an exemplary embodiment, wherein the fastener includes at least one material selected from hook or loop material.

In an exemplary embodiment, wherein the flap is further attached to the protector pocket by a button.

In an exemplary embodiment, wherein the flap is further attached to the protector pocket by at least one material selected from hook or loop material.

In an exemplary embodiment, wherein the flap is further attached to the protector pocket by a zipper.

In an exemplary embodiment, wherein the protector pocket further comprises at least one of: cotton, nano particles, silk, or Kevlar®, Teflon® coating, Poly-Rayon, Polyester microfiber, Polyester, Rayon, Cotton Spandex, wool, denim, Poly-Spandex, Cool Max®, leather, flannel or Gor-Tex®.

In an exemplary embodiment, wherein the flap pocket further comprises at least one of: cotton, nano particles, silk, or Kevlar®, Teflon® coating, Poly-Rayon, Polyester microfiber, Polyester, Rayon, Cotton Spandex, wool, denim, Poly-Spandex, Cool Max®, leather, flannel or Gor-Tex®.

In an exemplary embodiment, further comprising a necklace allowing protector pocket to be worn around the neck.

In an exemplary embodiment, wherein the protector pocket is attached to the necklace using an arm attached to the pocket.

Additionally, in an exemplary embodiment, the pocket can be attached to the clothing material with thread, hook-and-loop material, such as Velcro®, or any other type of material used for adhering pockets to clothing.

In another exemplary embodiment, it is contemplated that the "eyewear protector pocket" and clothing material can be made of any material including cotton, silk, polyester or any other materials or combinations of materials. Each clothing item might have a minimum of one "eyewear protector pocket" but may also have an unlimited number of "eyewear protector pockets." The "eyewear protector pocket" may provide a convenient and safe location to keep eyewear that is easily accessible.

In yet another exemplary embodiment, the "eyewear protector pocket" may benefit people who wear glasses for reading, need to have glasses or sunglasses for driving a car or to protect their eyes from sun damage, etc., by having them easily accessible will save time without having to search for them when they need them. The time saved not searching for eyewear may be used for, e.g., other more fun or more productive activities such as reading investment reports, reading a novel, watching TV, playing a board game, etc. In some cases, a common complaint by eyewear users is that they waste a lot of time searching for their glasses. When all the time spent by eyewear users searching for their eyewear is calculated, it can be a great amount of time that could be used for more productive activities or enjoyable activities.

A further exemplary embodiment contemplates that the "eyewear protector pocket" may also benefit a person's health by reducing stress created by wasting time searching for misplaced eyewear. The "eyewear protector pocket" may reduce stress caused by searching for eyewear which can result in better health to the eyewear user by reducing stress induced illness. The "eyewear protector pocket" may also provide an economic benefit to eyewear wearers because by using the "eyewear protector pocket" they can generally find the location of their eyewear (when located in the eyewear pocket and the location of the eyewear pocket is known) and will not have to suffer the cost of replacing lost eyewear. Accordingly, they might not have to replace eyewear accidently left on a table somewhere or any other of a myriad of locations.

In another exemplary embodiment the "eyewear protector pocket" may also provide a safety benefit to users by having their glasses available to read small print that is important or critical to their safety or health such as the fine print on the medicine bottle that may or may not be their correct medication or reading the instructions on some equipment. Not reading the instructions on equipment clearly because a person's glasses are missing could be unsafe and result in injury or death.

In some cases, the use of the "eyewear protector pocket" can save the user time, allow them to be more productive with their time, be a health benefit by reducing stress, and help prevent accidents caused by not having their eyewear easily accessible. Additionally, the "eyewear protector pocket" may provide a more secure alternative to wearing eyewear on a chain or cord around the neck. The chain or cord often break and the wearer does have to revert to old methods to carry their eyewear, such as in their hands, and eventually sets them down somewhere which creates the potential of losing or misplacing them.

Among the many different possibilities contemplated, the "eyewear protector pocket" may provide a safer alternative for people that wear their glasses on the back of their neck, on the top of their head, hanging from the front of their shirt or holding them in their hand. These locations are not as safe or secure as placing the eyewear in the "eyewear protector pocket" and often result in the glasses falling which damage, scratch or break the lenses and that impairs the vision of the user.

In some examples, the "eyewear protector pocket" may also help reduce the loss of countless pairs of eyewear that are left sitting on a chair, table, counter, desk, drawer, etc., or somewhere because the wearer put them down and left the location without their eyewear. In some cases, the "eyewear protector pocket" may also be a benefit to golfers. When the golfer needs to remove his glasses on the golf course, the "eyewear protector pocket" might prevent the golfer from leaving them in the golf cart, at the café, on the grass or stepping on them on the tee or green after he removed them to hit his shot.

In still another exemplary embodiment, it is contemplated that there can be double alternative designs for the "eyewear protector pocket" that are limitless in number, materials, colors, fasteners, application and use for clothing wear.

In yet another exemplary embodiment, the materials used for the "eyewear protector pocket, in order to provide strength to protect the eyewear, can include a mixture of nano particles or titanium particles blended into other materials such as cotton, silk, etc.

In another embodiment, a mixture of nano particles or titanium particles might be sprayed on other materials such as cotton, silk, etc.

In an embodiment, a mixture of materials may provide a light-weight pocket construction that can provide a much stronger pocket for the protection of the eyewear and comfort of wear for the user. Additionally, this nano/titanium/cotton etc. material may prevent damage to the eyewear in the "eyewear protector pocket" in the event of a fall or some other impact to the pocket and/or the user.

The formula for providing the best light-weight protection for the design of the pocket can vary from embodiment to embodiment according to the strength needed for the various types of clothing material combinations such as cotton, nano particle, silk, and all others manufactured by unlimited methods.

In yet another embodiment, many other formulas for additions, compositions or particles are contemplated.

In another exemplary embodiment, a loop on the detachable pocket (as an alternative to the fixed pocket designed into a garment) that would be slid onto a belt around the waist. The loop might be solid or of hook and loop material to also be detachable from the belt.

In yet another exemplary embodiment, a hook and loop material patch with a detachable cover/flap to open and attach a separate eyewear protector pocket with the hook and loop material attached.

In another exemplary embodiment, grommets that can be placed on or in the clothing to receive a strap with push button release (such as on a back pack) connected to a detachable eyewear protector pocket.

Among the many different possibilities contemplated, metal snaps on the clothing that snaps into receptors on the detachable eyewear protector pocket. The number and design, of snaps vary.

In another exemplary embodiment, the fixed pocket could be located on the exterior or interior of all clothing. Access might be from the front or inside the garment.

In another exemplary embodiment, the eyewear protector pocket could be located on hats.

In yet another exemplary embodiment, the pocket could be lined with glass cleaning cloth and pocket connected to garment.

Among the many different possibilities contemplated, the eyewear protector pocket could be used on military clothing, all sportswear, etc.

In yet another exemplary embodiment, the eyewear protector pocket could be located anywhere on the garment, including the sleeves, the back, the front, sides, in unlimited number.

In another exemplary embodiment, the eyewear protector pocket detachable could have a loop that fits around a button on the garment.

In yet another exemplary embodiment, the eyewear protector pocket detachable could have a snap on the back that connects to a snap on the button of the garment. The snap on the button acts as a button for the garment.

Among the many different possibilities contemplated, the fixed eyewear protector pocket as part of the garment has a normal appearance with the typical 6 inch deep design from the outside of the garment but has an extension on the inside to allow for securing eyewear of various lengths up to 8, 9 or more inches in length. The top of the eyewear protector pocket would have a zipper, hook and loop material or some other connector to secure the eyewear in the pocket.

In yet another exemplary embodiment, the eyewear could be attached to the outside of the garment with a hook and loop material tab or tabs that extend over the glasses at the bridge or some other secure part to hold the eyewear on the front of the garment. The hook and loop material tab could also be used on the interior of a garment pocket (or some other connector that would secure the eyewear.)

In another exemplary embodiment, the eyewear protector pocket is to be made of any material, including asbestos, Kevlar®, cotton, nano particles added to other materials, etc.

Among the many different possibilities contemplated, a connector may be attached to the detachable eyewear protector pocket that loops through an existing or new button hole on the garment to hold it secure.

A number of example embodiments have been discussed with respect to several "eyewear protector pockets." It will be understood by those of skill in the art that these examples can generally be applied to holders for various other implements to provide for securement and transport of many different types of personal items.

BRIEF DESCRIPTION OF THE DRAWINGS

FIG. 9 is a diagram illustrating an embodiment including a single pocket in accordance with embodiments described herein.

FIG. 10 is a diagram further illustrating the embodiment of FIG. 9.

FIG. 11 is a diagram further illustrating the embodiment of FIGS. 9 and 10.

FIG. 12 is a diagram illustrating an embodiment including a single pocket and a pull tab.

FIG. 13 is a diagram further illustrating the embodiment of FIG. 12.

FIG. 14 is a diagram further illustrating the embodiment of FIGS. 12 and 13.

FIG. 18 is a diagram illustrating an embodiment of a pocket in accordance with an embodiment described herein.

FIG. 19 is a diagram further illustrating the embodiment of FIG. 18.

FIG. 20 is a diagram illustrating an embodiment of a pocket in accordance with an embodiment described herein.

FIG. 21 is a diagram illustrating an embodiment of a pocket in accordance with an embodiment described herein.

FIG. 22 is a diagram further illustrating the embodiment of FIG. 21.

FIG. 23 is a diagram further illustrating the embodiment of FIGS. 21 and 22.

FIG. 24 is a diagram further illustrating the embodiment of FIGS. 21-23.

FIG. 25 is a diagram further illustrating the embodiment of FIGS. 21-24.

FIG. 26 is a diagram illustrating an embodiment of a pocket in accordance with an embodiment described herein.

FIG. 27 is a diagram illustrating an embodiment of a pocket in accordance with an embodiment described herein.

FIG. 28 is a diagram further illustrating the embodiment of FIG. 27.

FIG. 29 is a diagram illustrating an embodiment of a pocket in accordance with an embodiment described herein.

FIG. 30 is a diagram illustrating an embodiment of a pocket in accordance with an embodiment described herein.

FIG. 31 is a diagram illustrating an embodiment in accordance with an embodiment described herein.

FIG. 32 is a diagram illustrating an embodiment in accordance with an embodiment described herein.

FIG. 33 is a diagram illustrating an embodiment in accordance with an embodiment described herein.

FIG. 34 is a diagram illustrating an embodiment in accordance with an embodiment described herein.

FIG. 35 is a diagram illustrating an embodiment of a pocket in accordance with an embodiment described herein.

FIG. 36 is a diagram further illustrating the embodiment of FIG. 35.

FIG. 37 is a diagram further illustrating the embodiment of FIGS. 35 and 36.

FIG. 38 is a diagram further illustrating the embodiment of FIGS. 35-37.

FIG. 39 is a diagram illustrating an embodiment of a pocket in accordance with an embodiment described herein.

FIG. 40 is a diagram illustrating an embodiment of a pocket in accordance with an embodiment described herein.

DETAILED DESCRIPTION OF THE PREFERRED EMBODIMENT

Figure 1:
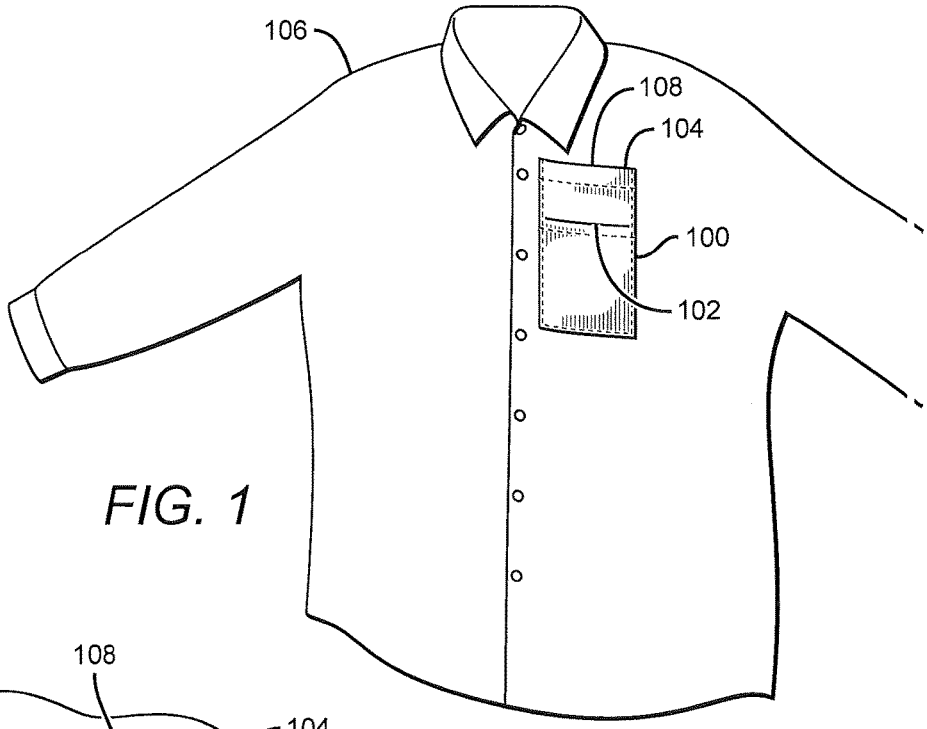
FIG. 1 is a diagram illustrating an embodiment including a double pocket in accordance with embodiments described herein.

FIG. 1 is a diagram illustrating an embodiment including a double pocket 100. The illustrated double pocket 100 includes a first pocket 102 and a second pocket 104. The pocket 100 may be attached to a dress shirt 106, as illustrated, t-shirt, collared shirt, blouse, sweatshirt, or other types of shirts or clothing.

In the illustrated embodiment the second pocket 104 can close using a hook and loop material 108. It will be understood that zippers, snaps, buttons, etc. might be used to hold the pocket 104 closed and that first pocket 102 might also use one or more of these to close the pocket.

Figure 2:
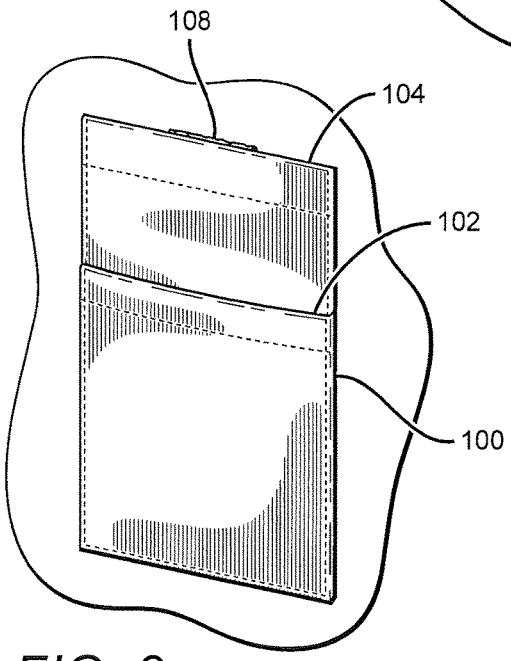
FIG. 2 is a diagram further illustrating the embodiment of FIG. 1.
Figure 3:
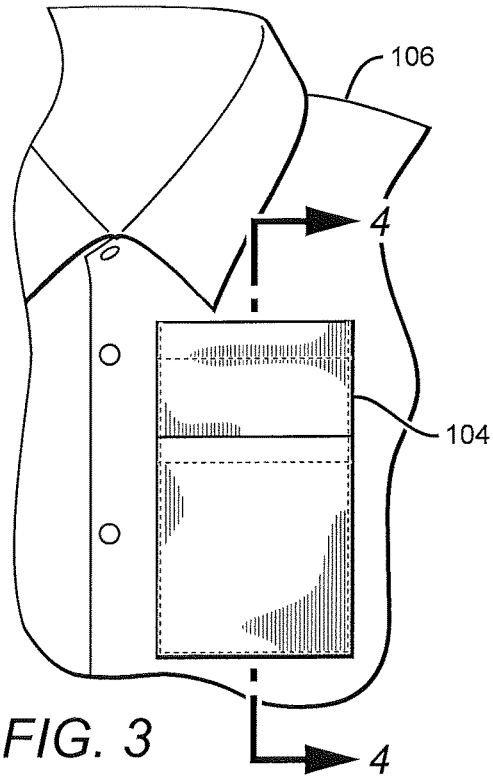
FIG. 3 is a diagram further illustrating the embodiment of FIGS. 1 and 2.
Figure 4:
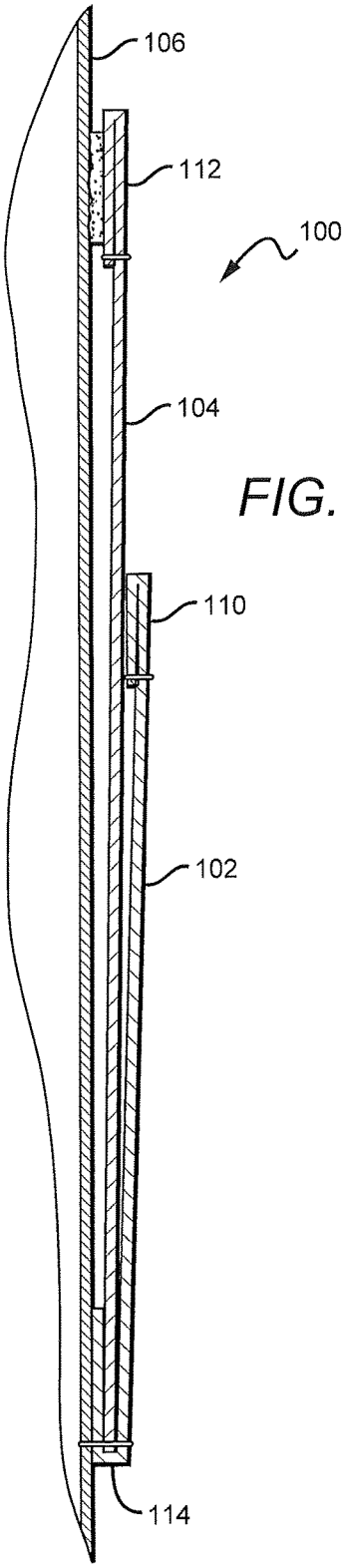
FIG. 4 is a diagram further illustrating the embodiment of FIGS. 1-3.

FIG. 2 illustrates a close up view of double pocket 100 including first pocket 102, second pocket 104, and hook and loop material 108. In the illustrated example shirt 106 may form the backing for the second pocket 104 as illustrated in FIGS. 3 and 4. In other examples double pocket 100, including first pocket 102 and second pocket 104 (including the backing) may be formed together.

FIG. 4 illustrates a side view of double pocket 100, including first pocket 102 and second pocket 104. As illustrated the double pocket 100 can be attached to shirt 106, which can form the back of second pocket 106. Folds 110, 112, 114 can form the top and bottom of each pocket 102, 104 to strengthen the top and bottom of the pocket.

Figure 5:
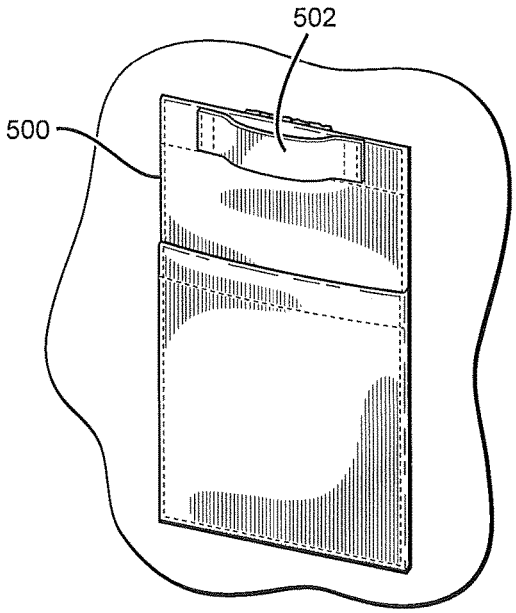
FIG. 5 is a diagram illustrating an embodiment including a double pocket and a pull tab.
Figure 6:
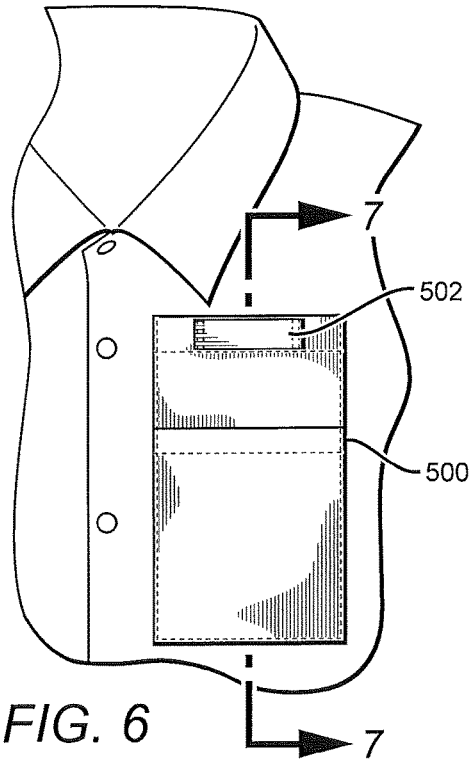
FIG. 6 is a diagram further illustrating the embodiment of FIG. 5.
Figure 7:
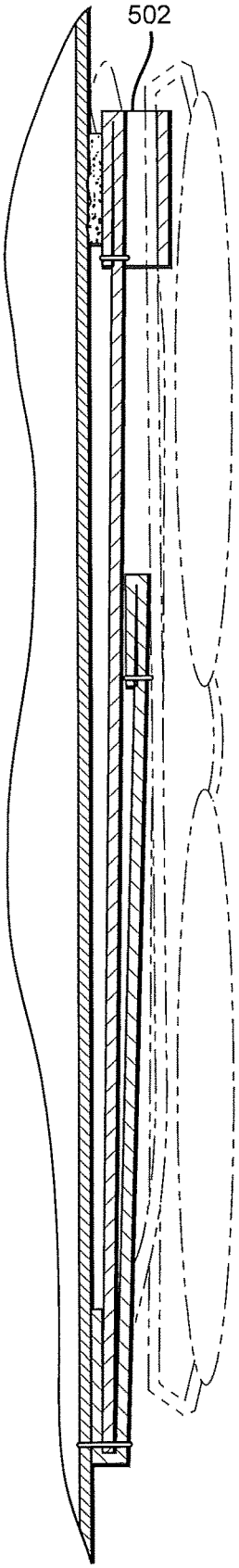
FIG. 7 is a diagram further illustrating the embodiment of FIGS. 5 and 6.
Figure 8:
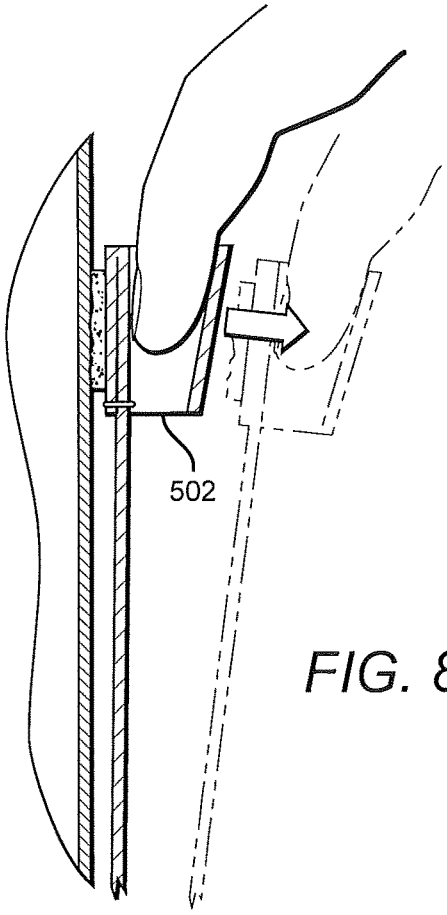
FIG. 8 is a diagram further illustrating the embodiment of FIGS. 5-7.

FIG. 5 is a diagram illustrating an embodiment of a pocket 500 in accordance with an embodiment described herein. Pocket 500 includes a pull tab 502 that includes a space that might be used, for example, to allow for a finger to open the longer pocket 504. This can allow for easier opening, e.g., when hook and loop material is used to secure the pocket 504. Additionally, the pull tab 502 might be used to hang eyewear or other personal items. It will be understood that the pull tab may be various sizes, shapes, colors, and designs. FIGS. 6-8 further illustrate pull tab 502. The pull tab 502 loop can include an open center that is not closed on the top or bottom, alternatively, it might be closed on the top or bottom or closed at both the top and bottom.

FIG. 9 is a diagram illustrating an embodiment including a single pocket 900 in accordance with an embodiment. The illustrated single pocket 900 may be attached to a dress shirt 902 as illustrated or a t-shirt, blouse, or other collared shirt, as well as sweatshirts, or other types of shirts or clothing. It will be understood that hook and loop material, zippers, snaps, buttons, etc. might be used to hold the pocket 900 closed.

FIG. 10 illustrates a close up view of pocket 900 and FIG. 11 is a side view of pocket 900 attached to shirt 902. In the illustrated embodiment of FIGS. 9-11 pocket 900 is generally located along the center line of the shirt 902. This can be useful for carrying, for example, sunglasses, a portable music player, etc. For example, by centering the pocket high on the shirt 900, when a portable music player is carried, any headphones, ear buds, or other speaker systems may be close to the ears and symmetrically located relative to each ear.

FIG. 11 illustrates a side view of pocket 900 attached to shirt 902 which may also include a top fold 904 of material. In the illustrated example shirt 902 may form the backing for pocket 900 as illustrated in FIG. 11. This can decrease the amount of material used in producing the pocket.

Some embodiments disclosed herein, such as those illustrated in FIGS. 1-11, as well as other embodiments, may include insulating material such that a cold bottle of, e.g., soda, water, might be carried and remain cold over an extended period of time. The insulating material may form a front and a back of the pocket to insulate the contents of the pocket from both the outside world and body heat from a wearer of the shirt. Additionally, some embodiments may close using hook and loop material, zippers, snaps, buttons, etc. In embodiments including insulating material the closable top may provide additional insulation from outside temperatures.

FIGS. 12-14 are diagrams illustrating an embodiment of a pocket 1200 with a pull tab 1202 similar to FIGS. 5-8. As illustrated, the pocket 1200 may be attached to a t-shirt. It will be understood that the hook and loop material, zippers, snaps, buttons, etc. might be used to hold the pocket 900 closed.

Figure 15:
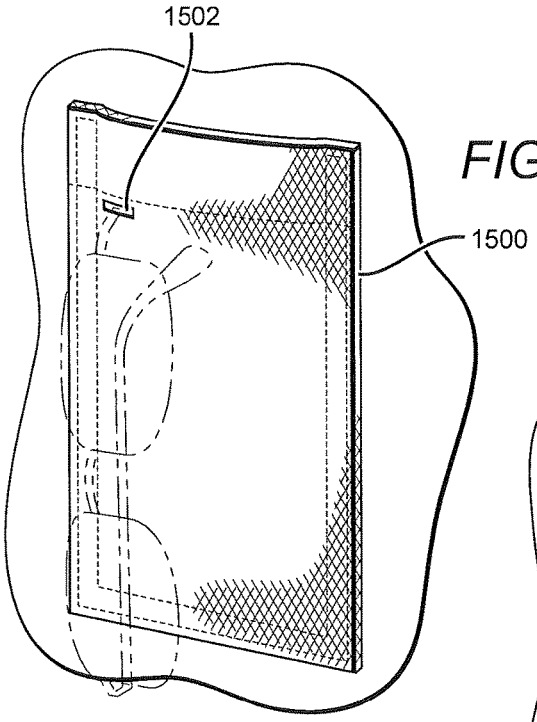
FIG. 15 is a diagram illustrating an embodiment of a pocket including a notch.

FIG. 15 is a diagram illustrating an embodiment of a pocket 1500 in accordance with an embodiment described herein that includes a notch 1502 in the material of the pocket 1500 that may be used to hold, for example, a pair of glasses 1504 as illustrated. It will be understood that the notch 1502 may also be a variety of other shapes such as a "V" shape, a square shape, a circular shape, an oval shape, etc.

Figure 16:
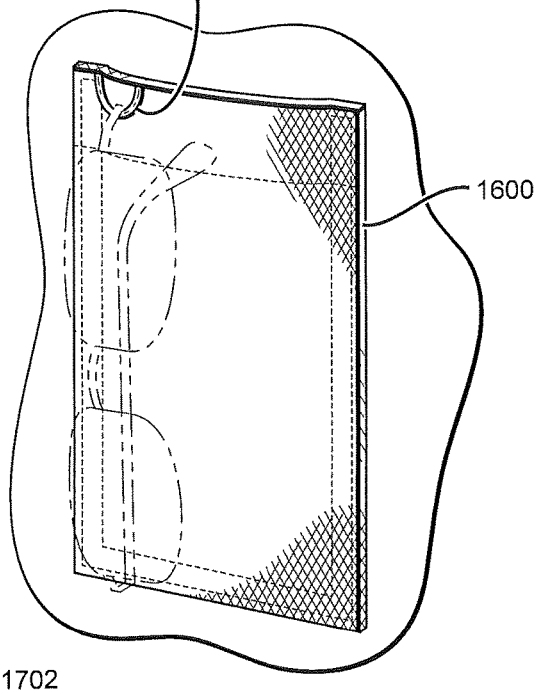
FIG. 16 is a diagram illustrating an embodiment of a pocket including a notch.

Similarly, FIG. 16 is a diagram illustrating an embodiment of a pocket 1600 in accordance with an embodiment described herein that includes a generally semicircular notch 1602 in the material of the pocket 1600 that may be used to hold, for example, a pair of glasses 1604 as illustrated. It will be understood that the notch 1602 may also be a variety of other shapes such as a "V" shape, a square shape, a rectangular shape, an oval shape, etc.

Figure 17:
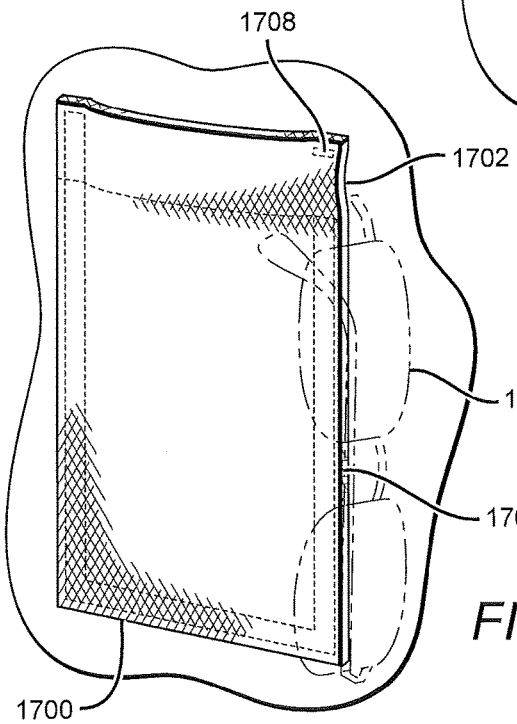
FIG. 17 is a diagram illustrating an embodiment of a pocket including a notch.
Figure 41:
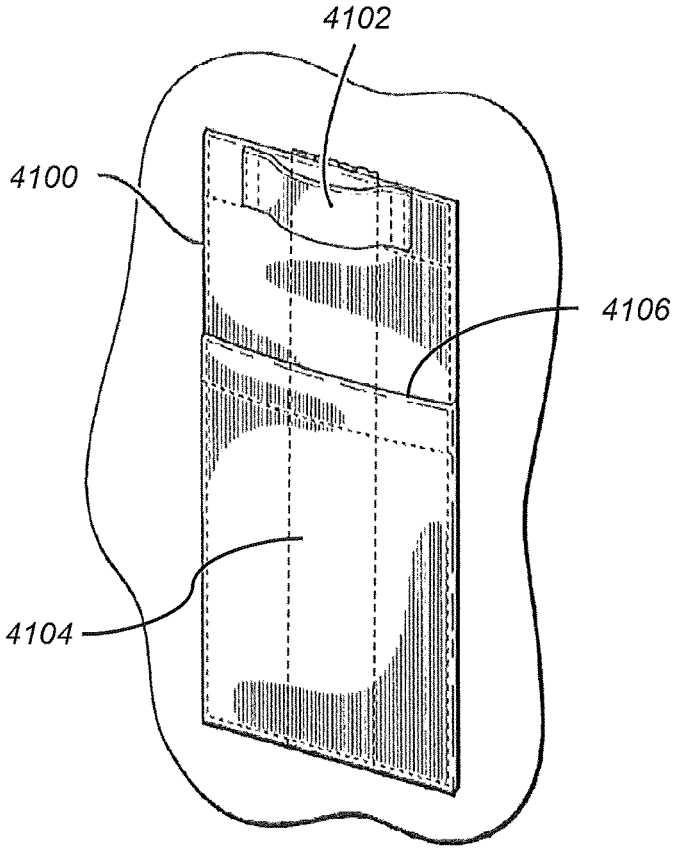
FIG. 41 is a diagram illustrating an embodiment including two protector pockets, a vertical loop, and a pull tab.

FIG. 17 is a diagram illustrating an embodiment of a pocket in accordance with an embodiment described herein that includes a notch 1702 formed in the side of the pocket 1700 that may be used to hold, for example, a pair of glasses 1704 as illustrated. The notch 1702 in the example embodiment is formed by having an area that does not include stitching. Note the gap between stitching 1706 and stitching 1708. A leg of glasses 1704 can be inserted into the gap at notch 1702. While the features of FIGS. 15-17 generally illustrates with respect to a single pocket without backing, it will be understood that the concept may be applied to a double pocket and, a pocket that includes backing discussed with respect to other figures, for example.

FIG. 18 is a diagram illustrating an embodiment of a pocket 1800 in accordance with an embodiment described herein. The pocket 1800 includes a loop 1802 that may be used for hanging eyewear or other items. In the illustrated embodiment, the loop 1802 can be located behind the pocket such that the eyewear might be hung from an arm on the back of the pocket and put inside the pocket or hung outside the pocket. As illustrated in FIG. 18 loop 1802 runs the length of the pocket 1800 behind the pocket 1800. In other embodiments the loop might be longer or shorter than the length of the pocket. Further, the loop might be placed on the outside of the pocket or between pockets in a multi-pocket design. FIG. 19 illustrates a cut away side view of the pocket 1800 of FIG. 18.

FIG. 20 illustrates a cut away side view of an alternative pocket 2000 design with a longer loop 2002. Pocket 2000 includes a loop 2002 and is similar to pocket 1800 with loop 1802, but the loop 2002 is longer than pocket 2000. As illustrated the rear loop 2202 extends longer than the length of the front pocket. In some embodiments the loop can be behind the pocket. The loop may also be on the inside of the shirt. Additionally, the bottom of loop might be open to provide for holding longer items such as an arm for eye wear, electrical devices, such as music players, or eye wear cases.

In other embodiments, a pocket might be hidden. The hidden inside pocket design can include a pocket placed on the inside of a shirt. In some cases the inside pocket might be accessed at the inside of the shirt. In other alternative embodiments, the shirt might be cut to allow access to the pocket. Embodiments of an inside pocket would generally look similar to, e.g., FIG. 9 if the embodiment with an inside pocket was "inside out." It will be understood that an inside pocket might be applied to many different types of shirts, however.

FIG. 21 is a diagram illustrating an embodiment of a pocket 2100 in accordance with an embodiment described herein. The pocket 2100 includes a top pocket edge design with a notch 2102. FIGS. 22-25 further illustrates the embodiment of FIG. 21 and a variety of example top edge designs for the notch 2102. The shape of the notch 2102 can be designed to mate with other complimentary mating surfaces or to help retain, e.g., a leg of eyewear. A pull tab might also be used in conjunction with the pocket.

FIG. 26 is a diagram illustrating an embodiment of a pocket 2600 in accordance with an embodiment described herein. The illustrated embodiment of FIG. 26 includes the pocket 2600 and a loop 2602.

FIGS. 27 and 28 illustrate a pocket 2700 that includes a mesh portion 2702. The pocket 2700 can be closed on the bottom and may be used to carry a variety of items such as credit cards, electronic devices, eyewear, or other items. The mesh 2702 might allow for heat dissipation, e.g., when an electronic device such as a music player is carried in the pocket 2700. Additionally, a loop at the inside back of the pocket might also be provided. (Other positioning for the loop 2704, as described herein, might also be used.) In an example the pocket 2700, loop 2704, etc, might be made from nylon or other material. The mesh bag may provide for an easier to clean pocket 2700 which may promote better health for the user. Additionally, the mesh 2702 and loop 2704 design may allow a user to insert the arm of eyewear or other personal item, case, container, etc. and allow the item to hang in front of the pocket. In the illustrated embodiment of FIG. 28 the mesh 2702 is looped back upon itself. In other embodiments a single layer of mesh may be used such that the shirt provides the back of the pocket. (The shirt may provide backing for a double pocket in one embodiment as illustrated.)

FIG. 29 is a diagram illustrating an embodiment of a pocket 2900 in accordance with an embodiment described herein that includes a wider pocket than an opening 2902 such that the opening 2902 is more narrow and may have a tendency to better contain articles stored therein.

FIG. 30 is a diagram illustrating potential pocket or loop 3002 placements on a t-shirt 3000. It will be understood that other placements are possible. The loop 3002 can be centered and might be used to hold glasses or electronic devices. When an electronic device is held the location may allow for more symmetrical routing.

FIG. 31 is a diagram illustrating an embodiment of a pocket in accordance with an embodiment described herein that includes a loop pull tab 3100 without the pocket. It will be understood that the loop 3100 might also be used in conjunction with a pocket. The loop pull tab 3100 can be open on the top and bottom and may also be located near the center of a shirt. It will be understood, however, that any other location on the shirt is also possible. The loop 3100 can be used to hold the arm of glasses, sunglasses, eyewear, etc. In the illustrated embodiment the loop is horizontal.

FIG. 32 is a diagram illustrating an embodiment in accordance with an embodiment described herein. In the illustrated example an eyewear case 3200 may include an arm 3202 that can be attached to loop pull tab 3204. The size of the case 3200 may vary and other types of cases for holding other items might be used. The case 3200 can hold an item on the front of a shirt, such as a t-shirt, blouse, etc. It might also be used with other types of apparel, such as any apparel that includes the loop pull tab 3204 or other location where the case 3200 might be attached.

In another example case 3200 can be an electronics case that can be attached to loop pull tab 3204. As described with respect to the eyewear case, the size of the case may vary and other types of cases for holding other items might be used. The case 3200 can hold an item on the front of a shirt, such as a t-shirt, blouse, etc. It might also be used with other types of apparel, such as any apparel that includes the loop pull tab 3204 or other location where the case 3200 might be attached. The case 3200 may be used to hold, for example, a portable music player, camera, mobile telephone handset, etc.

FIG. 33 illustrates an embodiment of a badge holder apparatus 3300 in accordance with an embodiment described herein. The badge holder apparatus 3300 can be used to hold, for example, an identification badge, or other items. Additionally, apparatus 3300 can include an arm 3302 that can be used with a loop pull tab. The arm 3302, as well as other arms in other embodiments might also be used with a necklace such that the apparatus 6300 can be worn around the neck. In this way a pocket can be provided that can be hung around the neck.

FIG. 34 illustrates an embodiment of an accessory protector apparatus 3400 in accordance with an embodiment described herein. The accessory protector apparatus 3400 can be used to hold, for example, an identification badge, or other items. Additionally, the accessory protector apparatus 3400 can include an arm 3402 that can be used a loop pull tab 6500. The arm 3402, as well as other arms in other embodiments might also be used with a necklace 3404 such that the accessory protector apparatus 3400 can be worn around the neck. In this way a pocket can be provided that can be hung around the neck. The pocket of the accessory protector apparatus 3400 may be used to hold eyeglasses, electronics, etc. and may be made of many different types of materials such as cotton, wool, metal, wood, rubber, etc. In the illustrated embodiment the necklaces 3404 is attached to the apparatus 3400. In another embodiment, the arm 3402 or a clip may be used to attach the accessory protector apparatus 3400 to the necklace 3404, other loop, or used in conjunction with a pocket.

FIGS. 35-38 illustrate a single pocket 3500 that includes backing 3502. From the front pocket 3500 generally looks similar to pocket 900, however, as illustrate in the top, bottom, and side views of FIGS. 36, 37, and 38 respectively the pocket 3500 is formed from a front portion 3504 and backing 3502 which may be attached to a shirt 3506.

FIG. 39 is a diagram illustrating an embodiment of a shirt 3900 including a pocket 3902 in accordance with an embodiment described herein. The pocket 3902 includes a loop tab 3904 that is behind the pocket 3902 and open on both ends to accept a strap with a clip or other connector to hang eyewear, eyewear container, portable electronic device container, portable electronic device, etc.

FIG. 40 is a diagram illustrating another embodiment of a pocket 3902 in accordance with an embodiment described herein. The shirt 4000 includes a pocket 3902 that is the same or similar to the pocket 3902 of FIG. 39 and a pocket 4002 that includes a loop 4004 open at both ends that is oriented vertically.

The loops 3904 and 4004 can be behind the pockets 3902, 4002 as illustrated, or in the front of the pockets 3902, 4002. Additionally, the loops 3904 and 4004 can be between the pocket and the shirt, hidden inside the shirt, etc. The loops 3904 and 4004 may be formed from material added inside the pocket 3902, 4002, or formed from a back portion of the pocket 3902, 4002.

FIG. 40 illustrates an embodiment including a first protector pocket 4100, a second protector pocket 4106, a vertical loop 4104, and a pull tab 4102 similar to those already described herein.

In some embodiments the pockets, meshes, etc. may be Polytetrafluoroethylene (e.g., Teflon®) coating, leather, flannel and Gor-Tex® (Gore-Tex is a waterproof/breathable; typically a porous form of polytetrafluoroethylene with a micro-structure characterized by nodes interconnected by fibrils), Poly-Rayon, Polyester microfiber, Polyester, Rayon, Cotton Spandex, wool, denim, Poly-Spandex, Cool Max®, etc. with no limit to materials. Coolmax® is a series of moisture-wicking technical fabrics. The fabrics employ specially-engineered polyester fibres to improve "breathability" compared to natural fibres like cotton. In some embodiments the pockets, meshes, etc. may be made from combinations of these or other materials.

While the invention is subject to various modifications and alternative forms, specific embodiments thereof have been shown by way of example in the drawings and will herein be described in detail. The invention should be understood to not be limited to the particular forms disclosed, but on the contrary, the intention is to cover all modifications, equivalents, and alternatives falling within the spirit and scope of the invention.

What is claimed is:

1. A upper torso garment configured to secure and transport a plurality of items, the garment comprising at least one pocket assembly including first and second protector pockets that overlap one another and attached along bottom and side edges to the garment and top edges of each of the first and second protector pockets is openable;

the top edge of the second pocket is substantially higher than the top edge of the first protector pocket;

the first protector pocket includes insulation material covering an interior surface thereof so as to retain a beverage item and insulate contents of the beverage item from outside temperatures;

the second protector pocket of the at least one pocket assembly includes a pull loop with a first open portion;

wherein the pull tab loop is configured to secure eyewear and the second pocket is formed between the upper torso garment and the first protector pocket; and a notch formed on the top edge of the second protector pocket, wherein the notch comprising at least one of a V-shape, a square shape and a circular shape.

2. The upper torso garment of claim 1, wherein the first and second protector pockets comprise a polytetrafluorethylene coating.

3. The upper torso garment of claim 1, wherein titanium particles are blended into the material of the first protector pocket so as to provide additional strength for content retention.

4. The upper torso garment of claim 1, wherein the second pocket protector includes one of a zipper, button and hooks about the top edge thereof.

* * * * *